US007256794B2

(12) United States Patent
Myoung et al.

(10) Patent No.: US 7,256,794 B2
(45) Date of Patent: Aug. 14, 2007

(54) METHOD AND APPARATUS FOR PROCESSING VIDEO DATA OF DISPLAY DEVICE

(75) Inventors: Dae Jin Myoung, Goyang-si (KR); Jun Hak Lee, Suwon-si (KR)

(73) Assignee: LG Electronics Inc., Seoul (KR)

( * ) Notice: Subject to any disclaimer, the term of this patent is extended or adjusted under 35 U.S.C. 154(b) by 116 days.

(21) Appl. No.: 11/009,134

(22) Filed: Dec. 13, 2004

(65) Prior Publication Data

US 2005/0140583 A1 Jun. 30, 2005

(30) Foreign Application Priority Data

Dec. 16, 2003 (KR) ..... 10-2003-0091782

(51) Int. Cl.
*G09G 5/02* (2006.01)

(52) U.S. Cl. ..... 345/596; 345/599; 382/236; 382/274; 382/275

(58) Field of Classification Search ..... None
See application file for complete search history.

(56) References Cited

U.S. PATENT DOCUMENTS 6,362,834 B2 * 3/2002 Ishii ..... 345/690
6,476,824 B1 * 11/2002 Suzuki et al. ..... 345/690
7,081,901 B1 * 7/2006 Ludden et al. ..... 345/596

FOREIGN PATENT DOCUMENTS

EP 1 136 974 A1 3/2000
GB 1359561 A1 * 5/2003

* cited by examiner

*Primary Examiner*—Mark Zimmerman
*Assistant Examiner*—Jwalant Amin
(74) *Attorney, Agent, or Firm*—KED & Associates, LLP

(57) ABSTRACT

Discloses herein is a method and apparatus for processing video data of a display device in which dithering noise generating when a motion picture is displayed can be minimized. According to the present invention, the method of processing the video data of the display device includes the steps of comparing data of an ith frame (i is a natural number) and data of a (i+1)th frame to determine whether the data of the (i+1)th frame is a motion picture or a still image, and employing a different dithering method depending upon the determination result of the motion picture or the still image.

22 Claims, 7 Drawing Sheets

METHOD AND APPARATUS FOR PROCESSING VIDEO DATA OF DISPLAY DEVICE

This Nonprovisional application claims priority under 35 U.S.C. § 119(a) on Patent Application No. 10-2003-0091782 filed in Korea on Dec. 16, 2003, the entire contents of which are hereby incorporated by reference.

BACKGROUND OF THE INVENTION

1. Field of the Invention

The present invention relates to a method and apparatus for processing video data of a display device, and more particularly, to a method and apparatus for processing video data of a display device in which dithering noise generating when a motion picture is displayed can be minimized.

2. Description of the Background Art

A variety of display devices such as a liquid crystal display panel, an electro luminescence panel and a plasma display panel has been developed and employed. Of them, the plasma display panel (hereinafter, referred to as a 'PDP') is adapted to display an image by using a visible ray generating from phosphors when ultraviolet generated by a gas discharge excite the phosphors. This PDP is advantageous it that it can provide the slimness, the compact size, higher definition and large screen, compared to a cathode ray tube (CRT) which has become the main stream of the display device so far.

FIG. 1 is a plan view schematically illustrating a conventional PDP. FIG. 2 is a perspective view illustrating the structure of the cell shown in FIG. 1.

Referring to FIGS. 1 and 2, the three-electrode AC surface discharge type PDP includes scan electrodes Y1 to Yn and sustain electrodes Z which are formed on the bottom surface of an upper substrate 10, and address electrodes X1 to Xm formed on the top of a lower substrate 18.

The discharge cells 1 of the PDP are formed at respective crossings of the scan electrodes Y1 to Yn, the sustain electrodes Z and the address electrodes X1 to Xm.

Each of the scan electrodes Y1 to Yn and the sustain electrodes Z includes a transparent electrode 12, and a metal bus electrode 11, which has a line width narrower than that of the transparent electrode 12 and is disposed at one edge side of the transparent electrode. The transparent electrode 12, which is generally made of ITO (indium tin oxide), is formed on the bottom surface of the upper substrate 10. The metal bus electrode, which is typically made of metal, is formed on the transparent electrode 12, and serves to reduce a voltage drop caused by the transparent electrode 12 having high resistance. On the bottom surface of the upper substrate 10 in which the scan electrodes Y1 to Yn and the sustain electrodes Z are formed is laminated an upper dielectric layer 13 and a protective layer 14. The upper dielectric layer 13 is accumulated with wall charges generated during plasma discharge. The protective layer 14 serves to prevent damage of the electrodes Y1 to Yn and Z and the upper dielectric layer 13 due to sputtering generated by the plasma discharge, and improve emission efficiency of secondary electrons. Magnesium oxide (MgO) is generally employed as the protective layer 14.

The address electrodes X1 to Xm are formed on the lower substrate 18 in a direction in which they cross the scan electrodes Y1 to Yn and the sustain electrodes Z. A lower dielectric layer 17 and barrier ribs 15 are formed on the lower substrate 18. The barrier ribs 15 are formed in the form of a stripe or grating to physically separate the discharge cells 1, thus prohibiting electrical and optical interference among discharge cells 1. The phosphor layer 16 is excited and light-emitted with ultraviolet generating during the plasma discharge to generate any one of red, green and blue visible rays.

An inert mixed gas such as He+Xe, Ne+Xe or He+Ne+Xe is injected into the discharge spaces of the discharge cells defined between the upper substrate 10 and the barrier ribs 15 and between the lower substrate 18 and the barrier ribs 15.

This PDP is driven with one frame being divided into a plurality of sub-fields having a different number of emission in order to implement the gray scale of an image. Each of the sub fields is divided into a reset period for uniformly generating a discharge, an address period for selecting a discharge cell, and a sustain period for implementing the gray level according to the number of a discharge. For example, if it is desired to display an image with 256 gray scales, a frame period (16.67 ms) corresponding to 1/60 second is divided into eight sub-fields. Each of the eight sub-fields is subdivided into the reset period, the address period and the sustain period. The reset period and the address period of each of the sub-fields are the same every sub-field, whereas the sustain period and the number of the discharge increase in the ratio of 2n (where, n=0,1,2,3,4,5,6,7) in each sub-field. As such, since the sustain periods become different in the respective sub-fields, the gray scale of an image can be implemented.

FIG. 3 is a block diagram of an apparatus for driving a PDP in a prior art.

Referring to FIG. 3, the apparatus for driving the PDP includes a gamma correction unit 30, an error diffusion unit 32, a dithering unit 34, a sub-field mapping unit 36 and a data driving unit 38 all of which are connected between an input line of video data and a panel 40.

The gamma correction unit 30 performs an inverse gamma correction operation on digital video data, which has undergone a gamma correction operation so that the data is suitable for a brightness characteristic of a cathode ray tube (CRT). In this time, the digital video data, which has undergone the inverse gamma correction operation by the gamma correction unit 30, has a linear brightness characteristic.

The error diffusion unit 32 diffuses error of the video data from the gamma correction unit 30 and pixels, which are calculated through an error diffusion filter, by using error diffusion coefficients. For example, as shown in FIG. 4, if the error diffusion operation is performed on a current pixel P5, error is diffused by assigning a weight of 1/16 to a pixel P1 adjacent to the pixel P5, a weight of 5/16 to a pixel P2, a weight of 3/16 to a pixel P3 and a weight of 7/16 to a pixel P4.

The dithering unit 34 expands the gray scale by selecting discharge cells to be turned on, through a dithering method that employs dither mask patterns. As such, if the gray scale is expanded through selection of the discharge cells to be turned on by means of the dithering method, contour noise can be removed. For example, European Patent Application No. 00250099.9, etc. discloses a method of selecting discharge cells to be turned on by using three-dimensional dither mask patterns corresponding to a plurality of frames, a plurality of lines and a plurality of columns in a plasma display panel.

The sub-field mapping unit 36 maps each of the pixel data from the dithering unit 34 to a predetermined sub-field pattern, and outputs the mapped results.

The data driving unit 38 latches the data, which is separated on a bit basis according to the sub-field patterns by the sub-field mapping unit 36, and supplies the latched data to address electrode lines of the panel 40 for one line every period where a horizontal line is driven.

Te panel 40 displays a given image corresponding to data, which is supplied from the data driving unit 38 to the address electrode lines.

Such a conventional PDP has a problem in that dithering noise is generated when a motion picture is displayed. This will be described in detail as follows. The dithering unit 34 employs dither mask patterns, which are different every frame. In reality, the dithering unit 34 uses dither mask patterns, which are repeated in an approximately two to four frame unit. In this time, dither values 1 of the dither mask patterns, which have the same gray scale and are also used in an ith (i is a natural number) frame and a (i+1)th frame, are disposed at different positions (e.g., grating patterns). For example, the dither mask patterns used in the ith frame and the (i+1)th frame can be set, as shown in FIG. 5.

In the case where a still image is displayed, if the still image is combined with the ith frame and the (i+1)th frame, discharge cells to be turned are selected in the form of gratings, as shown in FIG. 6. As such, if the discharge cells to be turned on are selected in the form of gratings, an image of the picture quality with no noise can be displayed. However, if a motion picture where the (i+1)th frame is moved by one pixel is to be displayed, dither mask patterns as shown in FIG. 7 are recognized to the eye of a man in the form of stripes. As such, if the discharge cells to be turned on are recognized in the form of stripes, noise of a specific shape is generated in an image displayed on the panel 40, which makes the eye of a man unpleasant.

SUMMARY OF THE INVENTION

Accordingly, the present invention has been made in view of the above problems, and it is an object of the present invention to provide a method and apparatus for processing video data of a display device in which dithering noise generating when a motion picture is displayed can be minimized.

To achieve the above object, according to the present invention, there is provided a method of processing video data of a display device, including the steps of: comparing data of an ith frame (i is a natural number) and data of a (i+1)th frame to determine whether the data of the (i+1)th frame is a motion picture or a still image, and employing a different dithering method depending upon the determination result of the motion picture or the still image.

According to the present invention, there is provided an apparatus for processing video data of a display device, including: a motion detection unit for comparing data of an ith frame (i is a natural number) and data of a (i+1)th frame to determine whether the data of the (i+1)th frame is a motion picture or a still image, and a dithering unit for employing a different dithering method depending upon the determination result of the motion picture or the still image.

According to the present invention, data of an ith frame and data of an (i+1)th frame are compared to determine whether the (i+1)th frame is a motion picture. If it is determined that the (i+1)th frame is the motion picture, dithering is performed so that one vertical line is not selected from dither mask patterns, which are first applied in the (i+1)th frame, by controlling a pixel clock. Thus, an image with no noise can be displayed.

BRIEF DESCRIPTION OF THE DRAWINGS

Further objects and advantages of the invention can be more fully understood from the following detailed description taken in conjunction with the accompanying drawings in which.

DETAILED DESCRIPTION OF PREFERRED EMBODIMENTS

Figure 1:
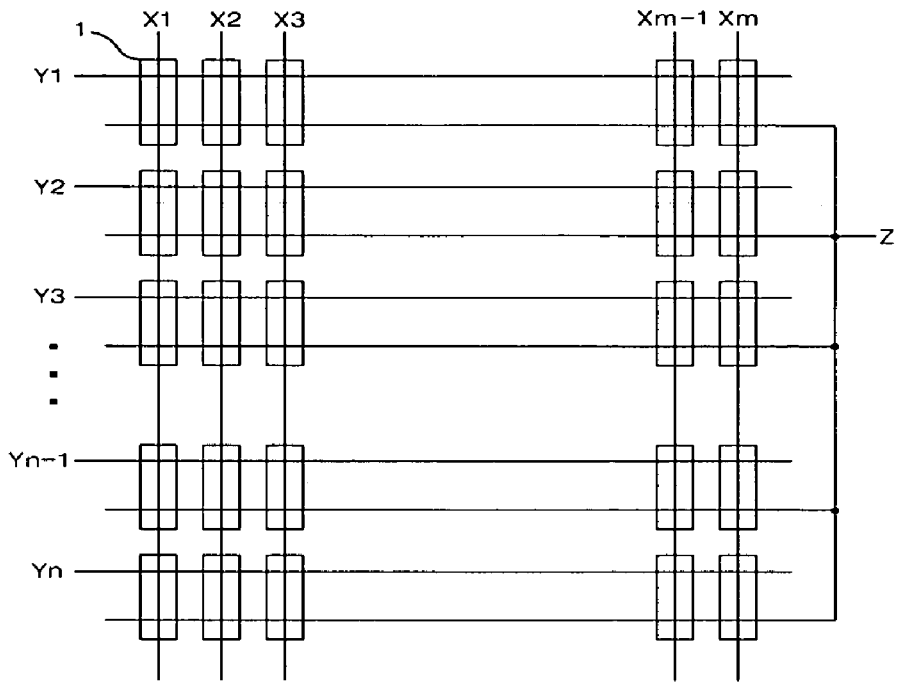
FIG. 1 is a plan view schematically illustrating a conventional PDP.
Figure 2:
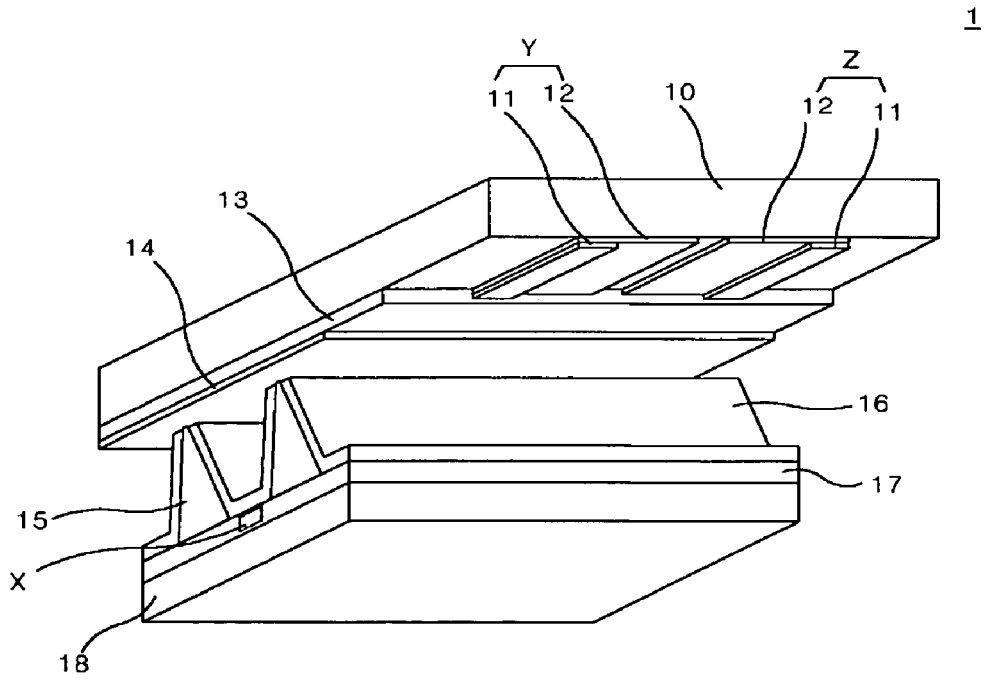
FIG. 2 is a perspective view illustrating the structure of the cell shown in FIG. 1.
Figure 3:
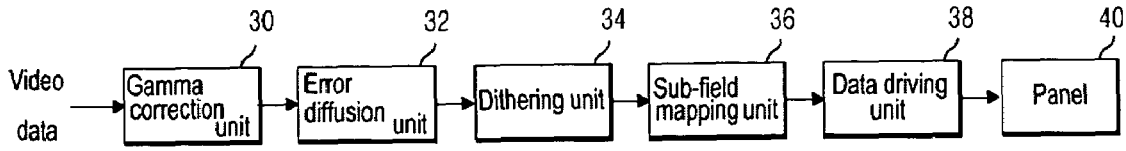
FIG. 3 is a block diagram of an apparatus for driving a PDP in a prior art.

According to the present invention, there is provided a method of processing video data of a display device, including the steps of: comparing data of an ith frame (i is a natural number) and data of a (i+1)th frame to determine whether the data of the (i+1)th frame is a motion picture or a still image, and employing a different dithering method depending upon the determination result of the motion picture or the still image.

In the dithering method, dithering is performed by selecting one of a plurality of dither mask patterns, which are disposed in the form of j (j is a natural number; horizontal)×j (vertical), by the use of gray scale values of inputted data and a vertical sync signal, and by extracting a specific dither value from the selected dither mask pattern by the use of a horizontal sync signal and a pixel clock.

If it is determined that the data of the (i+1)th frame is the motion picture, the dithering is performed by using j×j−1 dither mask patterns in which one vertical line is removed from the j×j dither mask patterns, when a first dither mask pattern is applied in the (i+1)th frame, and by using the j×j dither mask patterns when the remaining dither mask patterns except for the first dither mask pattern are applied.

The method further includes the step of controlling the pixel clock so that, in the (i+1)th frame, only the j×j−1 dither mask patterns are employed in the first dither mask pattern.

If it is determined that the data of the (i+1)th frame is the still image, the dithering is performed by using the j×j dither mask patterns.

According to the present invention, there is provided an apparatus for processing video data of a display device, including: a motion detection unit for comparing data of an ith frame (i is a natural number) and data of a (i+1)th frame to determine whether the data of the (i+1)th frame is a motion picture or a still image, and a dithering unit for employing a different dithering method depending upon the determination result of the motion picture or the still image.

The dithering unit performs dithering by selecting one of a plurality of dither mask patterns, which are disposed in the form of j (j is a natural number; horizontal)×j (vertical), by the use of gray scale values of inputted data and a vertical sync signal, and by extracting a specific dither value from the selected dither mask pattern by the use of a horizontal sync signal and a pixel clock.

If it is determined that the data of the (i+1)th frame is the motion picture, the dithering unit performs the dithering by using j×j−1 dither mask patterns in which one vertical line is removed from the j×j dither mask patterns, when a first dither mask pattern is applied in the (i+1)th frame, and by using the j×j dither mask patterns when the remaining dither mask patterns except for the first dither mask pattern are applied.

The dithering unit employs only the j×j−1 dither mask patterns in the first dither mask pattern in the (i+1)th frame by controlling the pixel clock.

If it is determined that the data of the (i+1)th frame is the still image, the dithering unit performs the dithering by using the j×j dither mask patterns.

Preferred embodiments of the present invention will be described in a more detailed manner with reference to FIGS. 8 to 12*b*.

Figure 8:
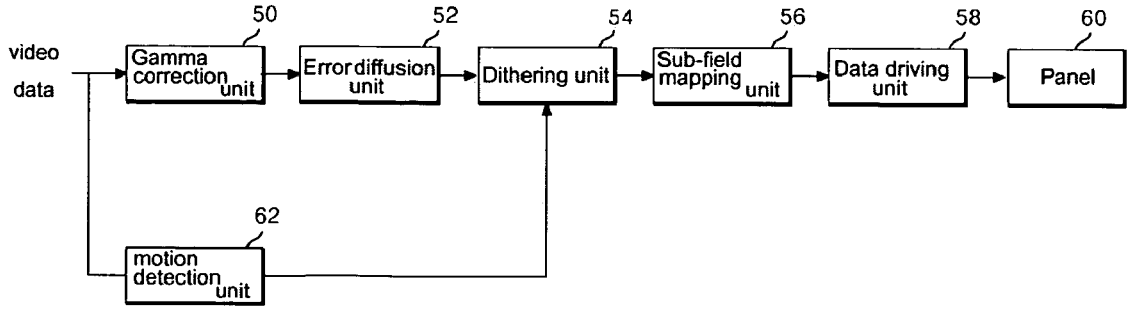
FIG. 8 is a block diagram of an apparatus for driving a PDP according to an embodiment of the present invention.

FIG. 8 is a block diagram of an apparatus for driving a PDP according to an embodiment of the present invention.

Referring to FIG. 8, the apparatus for driving the PDP according to an embodiment of the present invention includes a gamma correction unit 50, an error diffusion unit 52, a dithering unit 54, a sub-field mapping unit 56 and a data driving unit 58 all of which are connected between an input line and a panel 60, and a motion detection unit 62 connected between the input line and the dithering unit 54.

The gamma correction unit 50 performs an inverse gamma correction operation on digital video data, which has undergone a gamma correction operation so that the data is suitable for a brightness characteristic of a cathode ray tube (CRT). In this time, the digital video data, which undergone the inverse gamma correction operation by the gamma correction unit 50, has a linear brightness characteristic.

Figure 4:
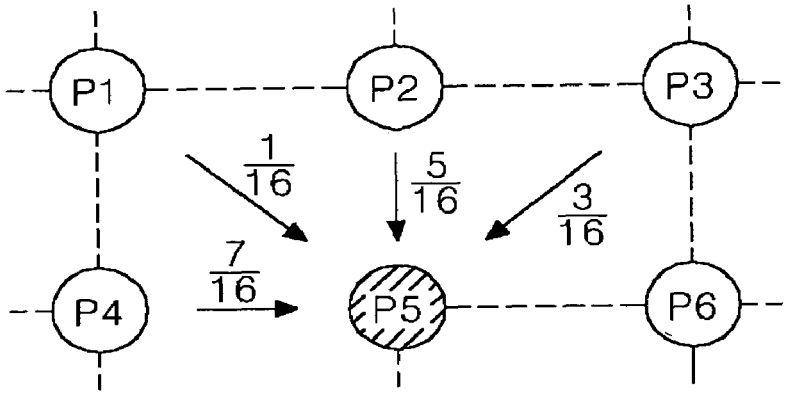
FIG. 4 is a diagram for explaining an error diffusion method, which is performed in the error diffusion unit shown in FIG. 3.
Figure 5:
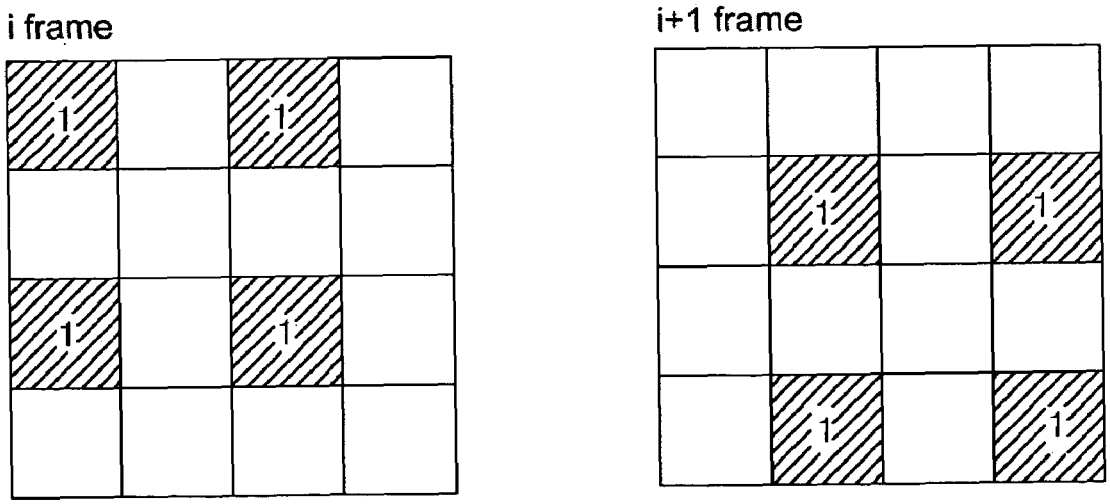
FIG. 5 is a view showing dither mask patterns in the dithering unit shown in FIG. 3.
Figure 6:
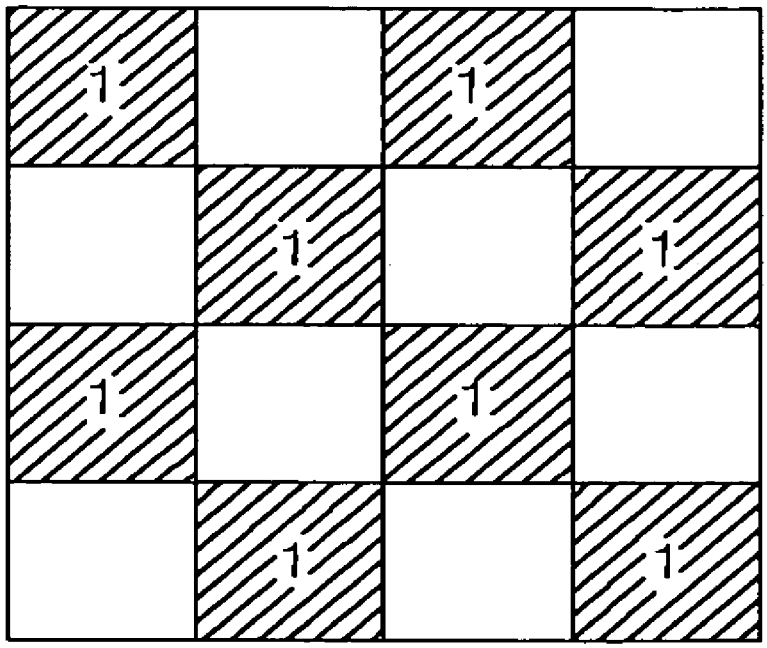
FIG. 6 shows a state where the dither mask patterns shown in FIG. 5 are applied to a still image.
Figure 7:
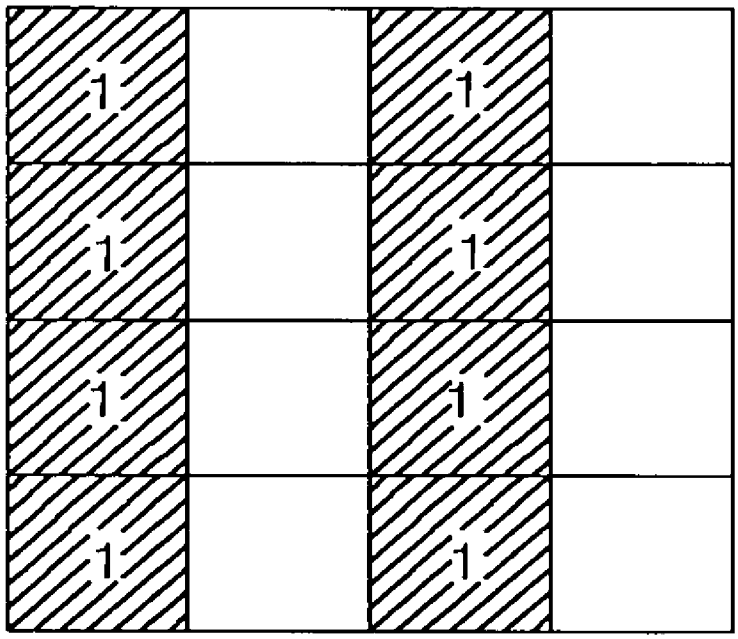
FIG. 7 shows a state where the dither mask patterns shown in FIG. 5 are applied to a motion picture.

The error diffusion unit 52 diffuses error of the video data from the gamma correction unit 50 and pixels, which are calculated through an error diffusion filter, by using error diffusion coefficients. For example, as shown in FIG. 4, if the error diffusion operation is performed on a current pixel P5, error is diffused by assigning a weight of 1/16 to a pixel P1 adjacent to the pixel P5, a weight of 5/16 to a pixel P2, a weight of 3/16 to a pixel P3 and a weight of 7/16 to a pixel P4. Furthermore, the error diffusion unit 52 can supply random weights to the pixel P5 so as to prevent error diffusion patterns.

The dithering unit 54 expands the gray scale by selecting discharge cells to be turned on, through a dithering method that employs dither mask patterns. Furthermore, in the case of a motion picture, the dithering unit 54 changes a method of selecting dither mask patterns under the control of the motion detection unit 62, thus preventing generation of dithering noise. A detailed operation of the dithering unit 54 will be given later on.

The motion detection unit 62 compares data in a frame unit to determine whether the data is a motion picture. If it is determined that the displayed image is the motion picture, the motion detection unit 62 applies a control signal to the dithering unit 54. This motion detection unit 62 determines whether a (i+1)th frame is a motion picture or a still image by comparing data of an ith (i is a natural number) frame and data of the (i+1)th frame.

The sub-field mapping unit 56 maps each of the pixel data from the dithering unit 54 to a predetermined sub-field pattern, and outputs the mapped results.

The data driving unit 58 latches the data, which is separated on a bit basis according to the sub-field patterns by the sub-field mapping unit 56, and supplies the latched data to address electrode lines of the panel 60 for one line every period where a horizontal line is driven. Te panel 60 displays a given image corresponding to data, which is supplied from the data driving unit 58 to the address electrode lines.

Figure 9:
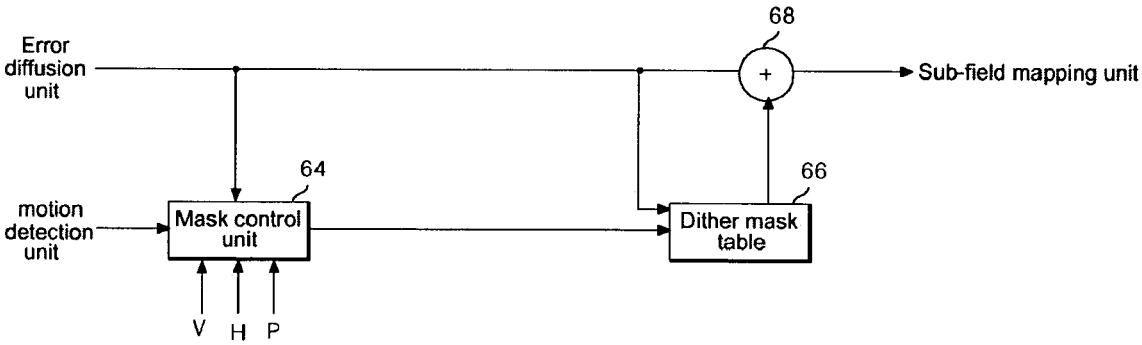
FIG. 9 is a detailed block diagram of the dithering unit shown in FIG. 8.

FIG. 9 is a detailed block diagram of the dithering unit 54 shown in FIG. 8.

Referring to FIG. 9, the dithering unit 54 includes a mask control unit 64, a dither mask table 66 connected between the mask control unit 64 and an output line of the error diffusion unit 52, and an adder 68 connected between the dither mask table 66 and the output line of the error diffusion unit 52.

The adder 68 adds dither values received from the dither mask table 66 to upper bits of pixel data received from the error diffusion unit 52.

Figure 10:
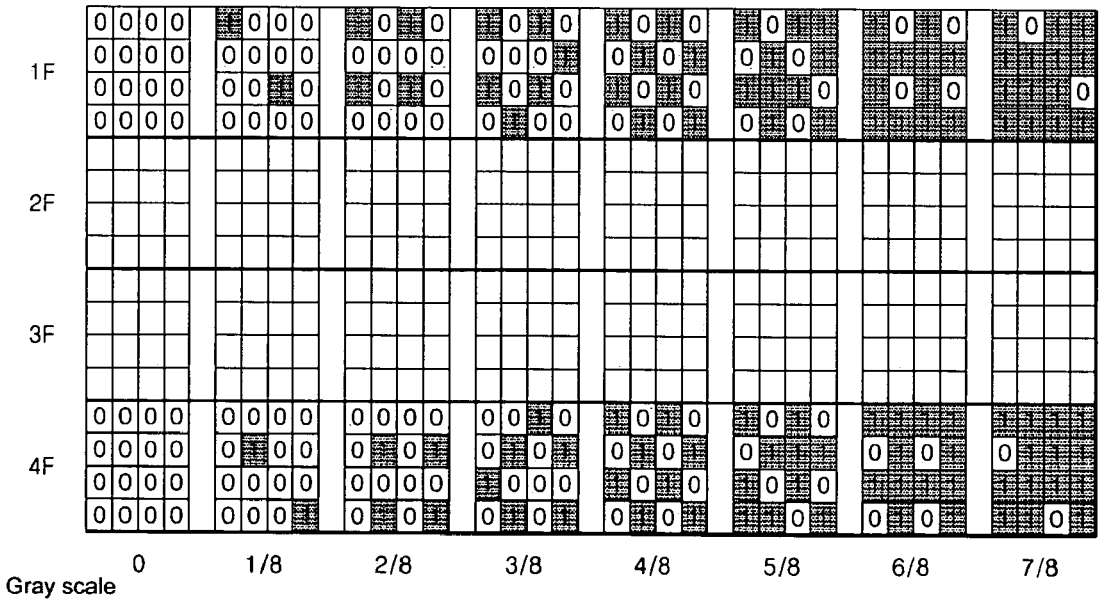
FIG. 10 illustrates dither mask patterns, which are employed in the dithering unit shown in FIG. 8.

The dither mask table 66 stores dither mask patterns, which are different every gray scale and frame. For example, as shown in FIG. 10, dither mask patterns has a cell (sub-pixel) size of 4×4 are separated every eight gray scales, such as 0 to 7/8, corresponding to lower 3 bits of input data, and each of the eight dither mask patterns is separated every four frames 1F to 4F. Thus, the dither mask table 66 stores a total of 32 dither mask patterns.

From FIG. 10, it can be seen that the number of cells, which are set to the dither value "1 in each of the dither mask patterns of the gray scales 0, 1/8, 2/8, 3/8, 4/8, 5/8, 6/8, 7/8 and 7/8, increases in order of 0, 2, 4, in number. It can be also known that the positions of the cells, which are set to the dither value 1, are different every four frames 1F to 4F. In each of the dither mask patterns, the position of "1" can vary according to a designer, if needed. The positions of on-cells corresponding to the dither value "1" can be controlled spatially and temporally depending upon these dither mask patterns. Furthermore, as the positions of the dither values "1" are different every gray scale and every frame in the dither mask patterns, dithering noise, such as grating noise caused by the repetition of constant dither mask patterns, can be reduced.

The operation when a still image is displayed will now be described. In the case where the still image is displayed, a control signal is not applied from the motion detection unit 62 to the mask control unit 64. The dither mask table 66 receives lower bits (e.g., 3 bits) of some of pixel data, which is received from the error diffusion unit 52. The dither mask table 66 then selects dither mask patterns of gray scales corresponding to the received lower bits from dither mask patterns as shown in FIG. 10. Next, the dither mask table 66 selects dither values corresponding to frames and cell position, which are indicated by the mask control unit 64, among the dither mask patterns of the selected gray scales, and outputs the selected dither values to the adder 68.

Figure 11A:
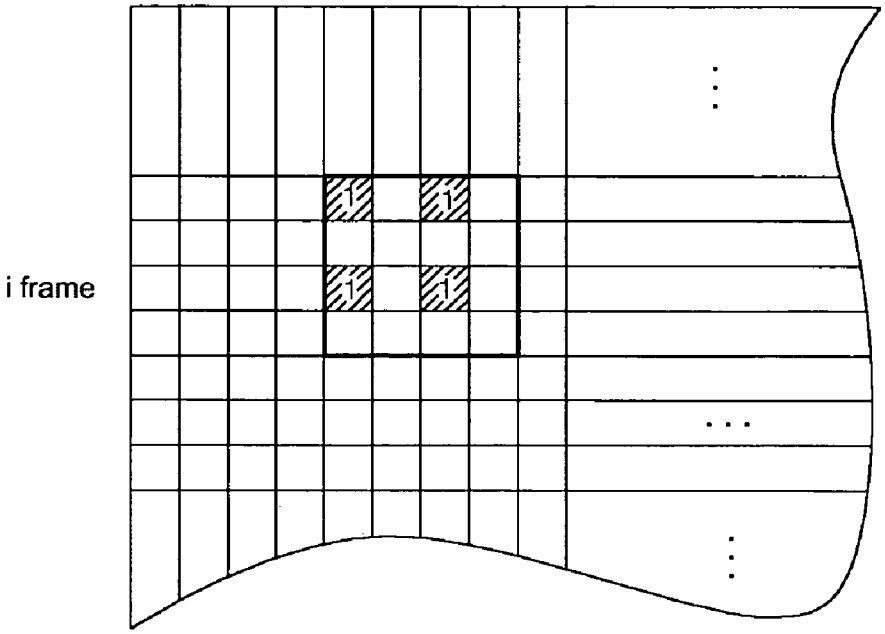
FIGS. 11*a* to 11*c* show states where dither mask patterns are applied to a still image.
Figure 11B:
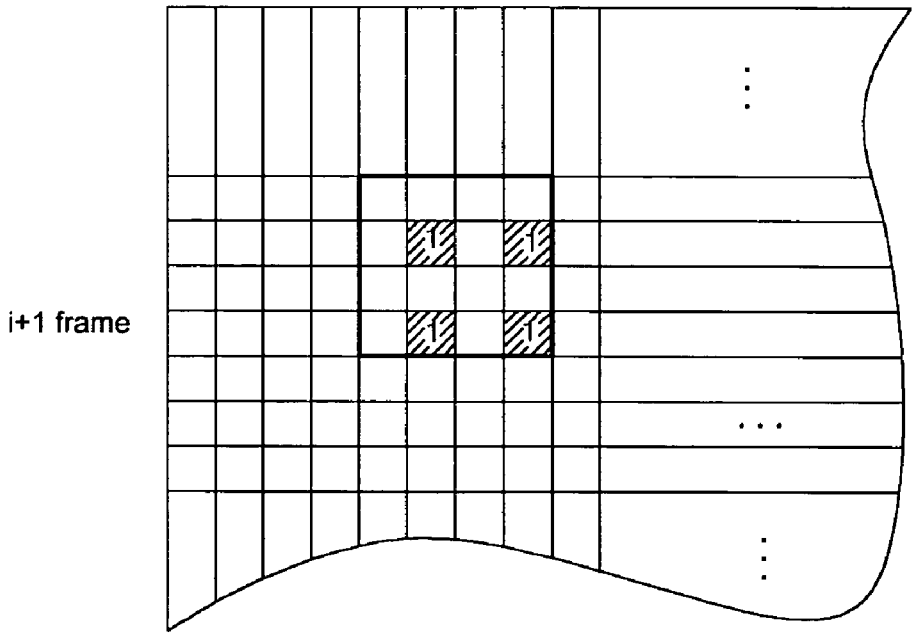
Figure 11C:
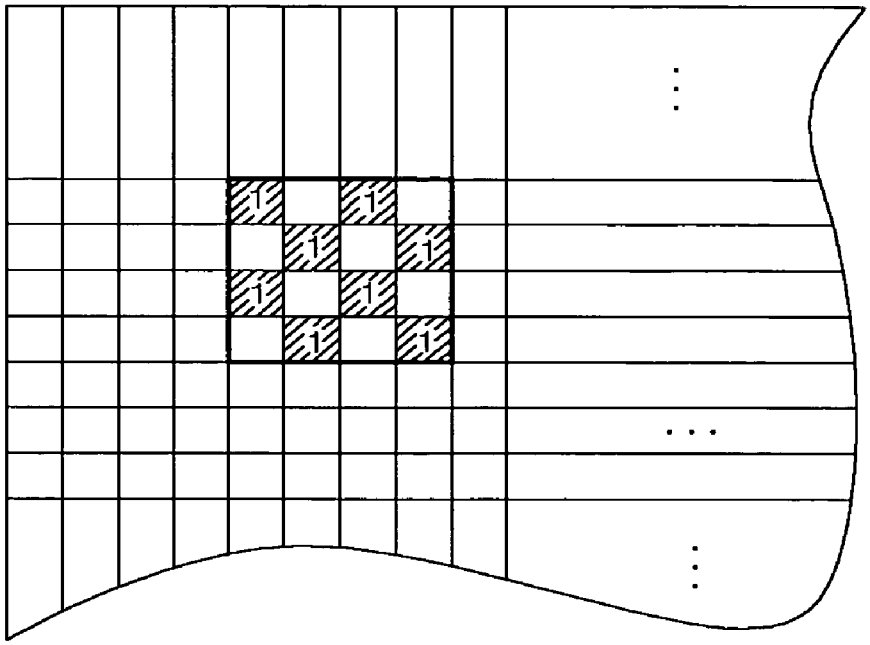

To this end, the mask control unit 64 counts a vertical sync signal V, which is received from an external control unit (not shown), to indicate a corresponding frame among the four frames 1F to 4F, and counts each of a horizontal sync signal H and a pixel clock signal P to indicate a horizontal line and a vertical line within the corresponding frame, i.e., a cell position. In this case, if a still image is displayed, dither mask patterns of an ith frame shown in FIG. 11*a* and dither mask patterns of a (i+1)th frame shown in FIG. 11*b* are combined at a specific position of the panel 60, so that discharge cells to be turned on in the form of gratings are selected, as shown in FIG. 11*c*. If the still image is displayed, an image with no noise can be displayed.

Meanwhile, the operation when a motion picture is displayed will now be described. In the case where the motion picture is displayed, the control signal is applied from the motion detection unit 62 to the mask control unit 64. The dither mask table 66 receives lower bits (e.g., 3 bits) of some of pixel data, which is received from the error diffusion unit 52. The dither mask table 66 then selects dither mask patterns of gray scales corresponding to the received lower bits from dither mask patterns as shown in FIG. 10. Next, the dither mask table 66 selects dither values corresponding to frames and cell position, which are indicated by the mask control unit 64, among the dither mask patterns of the selected gray scales, and outputs the selected dither values to the adder 68.

Figure 12A:
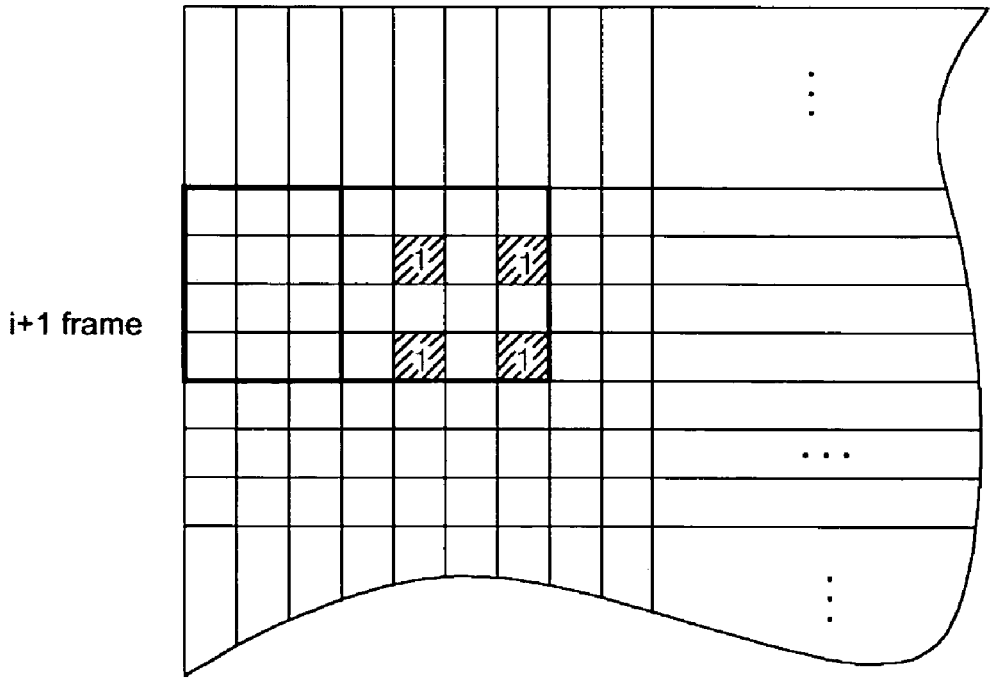
FIGS. 12*a* to 12*b* show states where dither mask patterns are applied to a motion picture.

To this end, the mask control unit 64 counts a vertical sync signal V, which is received from an external control unit (not shown), to indicate a corresponding frame among the four frames 1F to 4F, and counts each of a horizontal sync signal H and a pixel clock signal P to indicate a horizontal line and a vertical line within the corresponding frame, i.e., a cell position. Meanwhile, in the case where the control signal is received from the motion detection unit 62, the mask control unit 64 performs dithering by using dither mask patterns of 4 (horizontal)×3 (vertical) in which one vertical line is removed from a first dither mask pattern, i.e., 4×4 dither mask patterns, as shown in FIG. 12*a*. In this case, the mask control unit 64 performs dithering on patterns other than the dither mask patterns, which are applied for the first time, by normally using the 4×4 dither mask patterns. For this purpose, the mask control unit 64 controls a pixel clock P so that as much as one vertical line is not selected from the dither mask patterns, which are first applied in the (i+1)th frame, when the control signal is received from the motion detection unit 62.

Figure 12B:
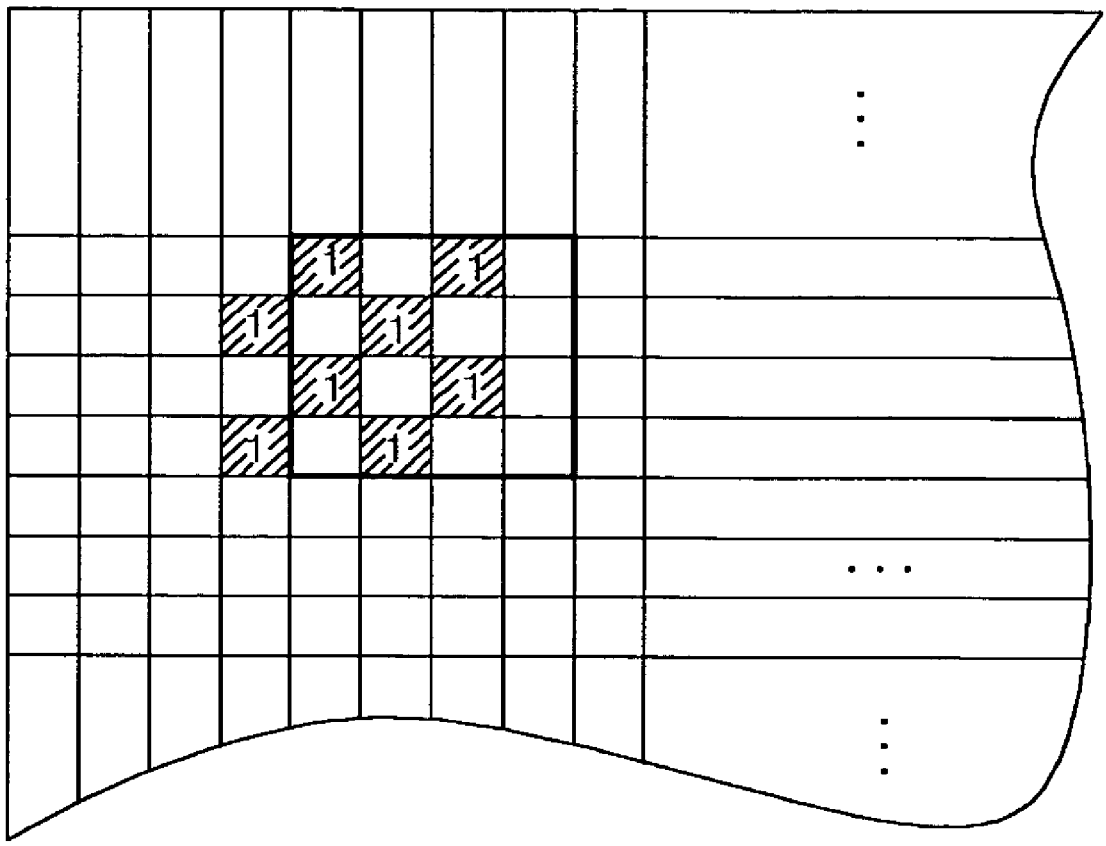

Meanwhile, if the dithering is performed by using the dither mask patterns of 4×3 (i.e., original j (by using only patterns of j(horizontal)×j−1(vertical) from patterns of j (j is a natural number; horizontal)×j (vertical)), which are first applied in the (i+1)th frame, the dither mask patterns of the ith frame and the (i+1)th frame are combined, and are thus recognized to the eye of a man in the form of gratings, as shown in FIG. 12*b*. That is, as the (i+1)th frame has moved by one pixel, the patterns are recognized to the eye of a man in the form of gratings, as shown in FIG. 12*b*. Accordingly, an image with no noise can be displayed even in a motion picture.

As described above, according to the present invention, data of an ith frame and data of an (i+1)th frame are compared to determine whether the (i+1)th frame is a motion picture. If it is determined that the (i+1)th frame is the motion picture, dithering is performed so that one vertical line is not selected from dither mask patterns, which are first applied in the (i+1)th frame, by controlling a pixel clock. Thus, an image with no noise can be displayed.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A method of processing video data of a display device, comprising:

(a) comparing data of an ith frame ("i" is a natural number) and data of a (i+1)th frame to determine whether the data of the (i+1)th frame is a motion picture or a still image; and (b) employing a different dithering method to display the video data on the display device depending upon the determination result of the motion picture or the still image, wherein, in the dithering method, dithering is performed by selecting one of a plurality of dither mask patterns, which are disposed in the form of j ("j" is a natural number; horizontal)×j (vertical), based on gray scale values of input data and a vertical sync signal, and by extracting a specific dither value from the selected dither mask pattern based on a horizontal sync signal and a pixel clock, and wherein if it is determined that the data of the (i+1)th frame is a motion picture, dithering is performed using one or more j×j−1 dither mask patterns in which one vertical line is removed from the j×j dither mask patterns when a first dither mask pattern is applied in the (i+1)th frame.

2. The method as claimed in claim 1, wherein wherein, when the (i+1)th frame is determined to be a motion picture, said dithering is further performed using the j×j dither mask patterns when the remaining dither mask patterns except for the first dither mask pattern are applied.

3. The method as claimed in claim 2, further comprising:

controlling the pixel clock so that, in the (i+1)th frame, only the j×j−1 patterns are employed in the first dither mask pattern.

4. The method as claimed in claim 1, wherein if it is determined that the data of the (i+1)th frame is the still image, the dithering is performed by using the j×j dither mask patterns.

5. An apparatus for processing video data of a display device, comprising:

a motion detection circuit for comparing data of an ith frame ("i" is a natural number) and data of a (i+1)th frame to determine whether the data of the (i+1)th frame is a motion picture or a still image; and a dithering circuit for employing a different dithering method depending upon the determination result of the motion picture or the still image, wherein:

the dithering circuit performs dithering by selecting one of a plurality of dither mask patterns, which are disposed in the form of j ("j" is a natural number; horizontal)×j (vertical), based on gray scale values of input data and a vertical sync signal, and by extracting a specific dither value from the selected dither mask pattern based on a horizontal sync signal and a pixel clock, and if it is determined that the data of the (i+1)th frame is a motion picture, the dithering circuit performs dithering using one or more j×j−1 dither mask patterns in which one vertical line is removed from the j×j dither mask patterns when a first dither mask pattern is applied in the (i+1)th frame.

6. The apparatus as claimed in claim 5, wherein, when the (i+1)th frame is determined to be a motion picture, the dithering circuit further performs dithering using the j×j dither mask patterns when the remaining dither mask patterns except for the first dither mask pattern are applied.

7. The apparatus as claimed in claim 6, wherein the dithering unit employs only the j×j−1 dither mask patterns in the first dither mask pattern in the (i+1)th frame by controlling the pixel clock.

8. The apparatus as claimed in claim 5, wherein if it is determined that the data of the (i+1)th frame is the still image, the dithering unit performs the dithering by using the j×j dither mask patterns.

9. A method of processing video data of a display device, comprising:

comparing first and second frames to determine whether the second frame corresponds to a motion picture or a still image; and performing a dithering method to display the video data on the display device, the dithering method performed being based on whether the second frame is a motion picture or still image, wherein if the second frame is a motion picture, dithering is performed using one or more dither mask patterns that have a fewer number of vertical lines than dither mask patterns used to perform dithering when the second frame is a still image.

10. The method as claimed in claim 9, wherein dithering is performed using one or more dither mask patterns that have one less vertical line than dither mask patterns used to perform dithering when the second frame is a still image.

11. The method as claimed in claim 9, wherein said one or more dither mask patterns having fewer vertical lines is generated by not selecting one or more vertical lines of the dither mask patterns used to perform dithering when the second frame is a still image.

12. The method as claimed in claim 11, wherein the one or more vertical lines of the dither mask patterns that are not selected are controlled based on a pixel clock.

13. The method as claimed in claim 9, wherein said dithering includes:

applying a first one of the dither mask patterns having said fewer number of vertical lines to the second frame; and applying subsequent dither mask patterns to the second frame that have a same number of vertical lines as dither mask patterns used to perform dithering when the second frame is a still image.

14. The method as claimed in claim 9, further comprising:

combining dither mask patterns of the first and second frames when the second frame is determined to be a motion picture, said combination being perceived by a viewer different as patterns different from a stripe pattern.

15. The method of claim 14, wherein said combination is perceived as a grating pattern.

16. An apparatus for processing video data of a display device, comprising:

a motion detection circuit to compare first and second frames to determine whether the second frame corresponds to a motion picture or a still image; and a dithering circuit to perform a dithering method to display the video data on the display device, the dithering method performed being based on whether the second frame is a motion picture or still image, wherein if the second frame is a motion picture, dithering is performed using one or more dither mask patterns that have a fewer number of vertical lines than dither mask patterns used to perform dithering when the second frame is a still image.

17. The apparatus as claimed in claim 16, wherein dithering is performed using one or more dither mask patterns that have one less vertical line than dither mask patterns used to perform dithering when the second frame is a still image.

18. The apparatus as claimed in claim 16, wherein said one or more dither mask patterns having fewer vertical lines is generated by not selecting one or more vertical lines of the dither mask patterns used to perform dithering when the second frame is a still image.

19. The apparatus as claimed in claim 18, wherein the one or more vertical lines of the dither mask patterns that are not selected are controlled based on a pixel clock.

20. The apparatus as claimed in claim 16, wherein said dithering circuit:

applies a first one of the dither mask patterns having said fewer number of vertical lines to the second frame; and applies subsequent dither mask patterns to the second frame that have a same number of vertical lines as dither mask patterns used to perform dithering when the second frame is a still image.

21. The apparatus as claimed in claim 16, further comprising:

a circuit to combine dither mask patterns of the first and second frames when the second frame is determined to be a motion picture, said combination being perceived by a viewer different as patterns different from a stripe pattern.

22. The apparatus as claimed in claim 21, wherein said combination is perceived as a grating pattern.

* * * * *